US009494303B2

(12) United States Patent
McGowan et al.

(10) Patent No.: US 9,494,303 B2
(45) Date of Patent: Nov. 15, 2016

(54) LED MODULE AND HOLDER WITH TERMINAL WELL

(71) Applicant: Molex, LLC, Lisle, IL (US)

(72) Inventors: Daniel B. McGowan, Glen Ellyn, IL (US); Carlos Carranza, Lake Forest, CA (US); Fred Jaklic, Brookfield, IL (US)

(73) Assignee: Molex, LLC, Lisle, IL (US)

( * ) Notice: Subject to any disclaimer, the term of this patent is extended or adjusted under 35 U.S.C. 154(b) by 75 days.

(21) Appl. No.: 14/382,500

(22) PCT Filed: Mar. 4, 2013

(86) PCT No.: PCT/US2013/028887
§ 371 (c)(1),
(2) Date: Sep. 2, 2014

(87) PCT Pub. No.: WO2013/131090
PCT Pub. Date: Sep. 6, 2013

(65) Prior Publication Data

US 2015/0109801 A1 Apr. 23, 2015

Related U.S. Application Data

(60) Provisional application No. 61/606,075, filed on Mar. 2, 2012.

(51) Int. Cl.
*F21V 19/00* (2006.01)
*F21V 23/06* (2006.01)
(Continued)

(52) U.S. Cl.
CPC ..... *F21V 19/004* (2013.01); *F21K 9/30* (2013.01); *F21V 23/06* (2013.01); *H01R 4/4818* (2013.01); *F21Y 2101/02* (2013.01); *F21Y 2105/001* (2013.01)

(58) Field of Classification Search
CPC .... F21K 9/30; F21V 19/0015; F21V 19/002; F21V 19/0025; F21V 19/003; F21V 19/0035; F21V 19/004; F21V 19/0055; F21V 23/06; F21S 2/005; F21S 48/1109; F21S 48/14104; H01R 4/4818; H01R 12/515; H01R 13/2442; H01R 33/09; H01R 33/18; H01R 33/94; H01R 12/714; H01R 12/721; H01R 12/75; H01R 4/4836; H01R 13/24; H01R 13/2407; H01R 13/2428; H01R 13/245; H01R 13/2464
See application file for complete search history.

(56) References Cited

U.S. PATENT DOCUMENTS 5,186,535 A * 2/1993 Yokoyama ..... F21S 48/1118 362/396
6,783,374 B2 8/2004 Uratani et al.
(Continued)

FOREIGN PATENT DOCUMENTS

JP 2008-258233 A 10/2008

OTHER PUBLICATIONS

International Search Report for PCT/US2013/028887.

*Primary Examiner* — Anh Mai
*Assistant Examiner* — Steven Horikoshi
(74) *Attorney, Agent, or Firm* — Jeffrey K. Jacobs

(57) ABSTRACT

A holder is disclosed that is configured to secure an LED array in position. An LED module is disclosed that includes an LED array that can be mounted to a suitable substrate and includes the holder the retain the LED array. The holder includes a housing that supports terminals that provide an electrical path to the LED array from an electrical power source. The housing and terminal provide a wire trap so that a conductor can be electrically connected to the LED array without the need for solder attach. The holder can be a one-piece or two-piece design.

20 Claims, 9 Drawing Sheets

(51) Int. Cl.

| | |
|---|---|
| ***F21K 99/00*** | (2016.01) |
| ***H01R 4/48*** | (2006.01) |
| *F21Y 101/02* | (2006.01) |
| *F21Y 105/00* | (2016.01) |

(56) References Cited

U.S. PATENT DOCUMENTS

2009/0196034 A1* 8/2009 Gherardini ..... F21K 9/00 362/235
2009/0244925 A1 10/2009 Snagel et al.
2011/0019409 A1* 1/2011 Wronski ..... F21V 7/00 362/235
2011/0136374 A1 6/2011 Mostoller et al.
2012/0133268 A1* 5/2012 Hwu ..... F21K 9/30 313/489
2012/0264326 A1 10/2012 Kudo et al.
2013/0122729 A1* 5/2013 Daily ..... F21V 19/003 439/220
2013/0176708 A1* 7/2013 Mostoller ..... F21V 19/0055 362/95

* cited by examiner

LED MODULE AND HOLDER WITH TERMINAL WELL

RELATED APPLICATIONS

This application claims priority to U.S. Provisional Application No. 61/606,075, filed Mar. 2, 2012, which is incorporated herein by reference in its entirety.

FIELD OF THE INVENTION

The present invention relates to the field of Solid State Lighting (SSL), more specifically to the field of modules suitable for use in SSL.

DESCRIPTION OF RELATED ART

In the field of SSL, an LED module can be used to provide illumination in residential, industrial and professional spaces. In most instances, several LED modules are required to provide enough illumination to specific areas of each respective space. This will include task lighting, room lighting and accent lighting applications. These existing applications require that individual LED modules be placed at appropriate locations and wired accordingly providing the necessary power to operate the lighting element. Existing modules, however, tend to be somewhat complicated to manufacture, thus raising the cost of the modules (and reducing the ability for user to adopt the newer, more efficient LED designs). Therefore, certain individuals would appreciate further improvements in the design of SSL modules.

BRIEF SUMMARY

A holder in disclosed that includes a terminal well and is configured to engage two sides of a LED array. The holder includes a housing with a terminal well and a terminal is positioned in the terminal well. The terminal includes an arm that is configured to engage a pad on the LED array. The terminal well includes a conductor notch that is aligned with a wire trap in the terminal. In an embodiment the terminal well can include two conductor notches that are at angles to each other and the terminal can include two wire traps so that the holder is configured to receive conductors inserted in two different angles.

In an embodiment, an LED module can include an LED array mounted with a holder configured to secure the LED array to a suitable substrate, the holder including a housing with a terminal well that supports a terminal. The terminal includes a wire trap that is aligned with a conductor notch in the terminal well. Thus, the LED module can provide an electrical path to the LED array from an electrical power source without the need for solder. The terminal well and the terminal are configured so that the terminal is retained directly in the terminal well. The holder can be a one-piece or two-piece design.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1:
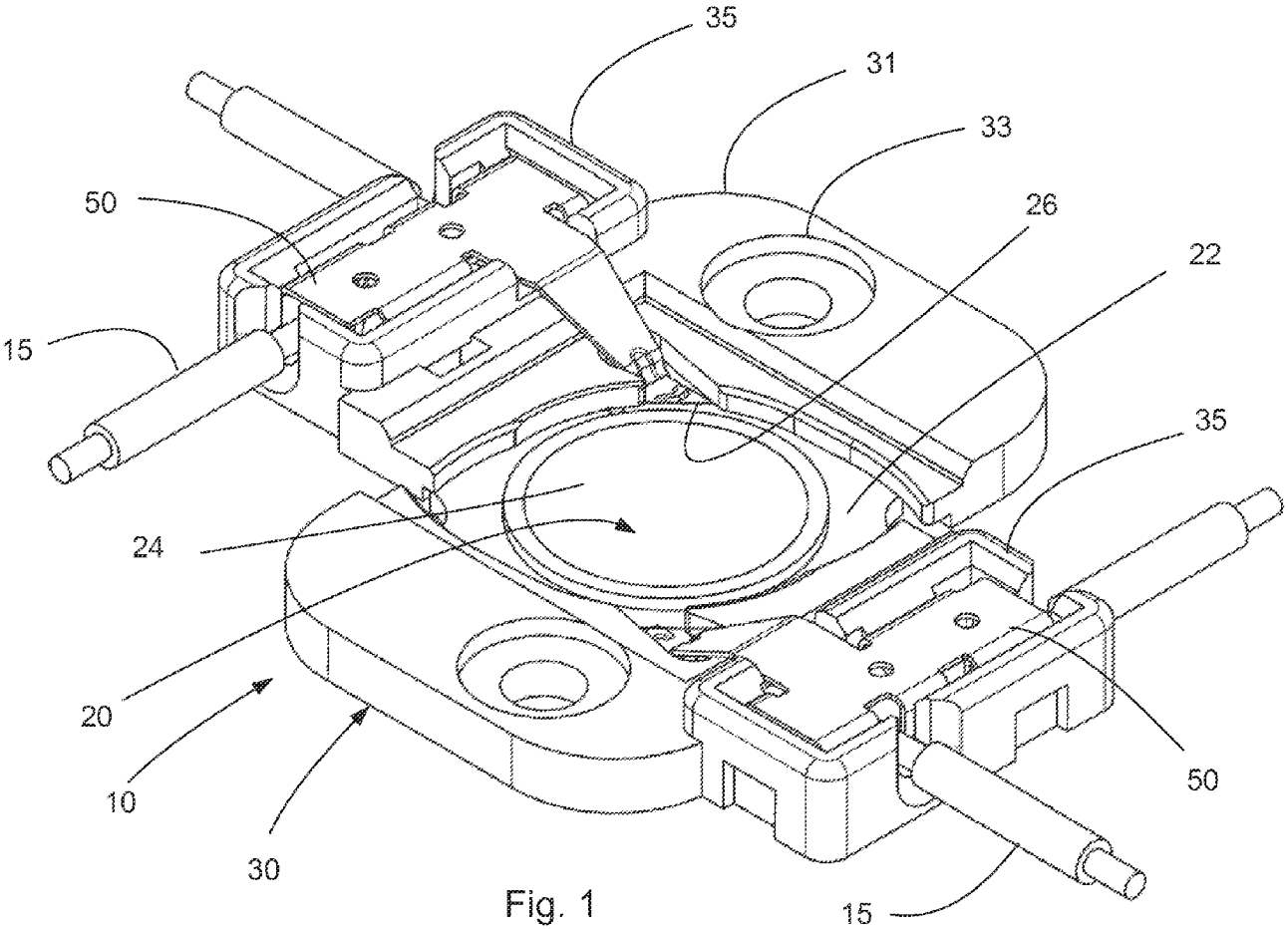
FIG. 1 illustrates a perspective view of an exemplary embodiment of an LED module.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

As shown in FIGS. 1-12, the LED module includes an LED array, a holder that is configured to retain the LED array to a substrate (not shown). The holder includes a housing that is molded of an insulative material and includes one or more terminal wells that are adapted to retain a terminal that is electrically conductive. The terminals include mounting portion with projections formed so as to engage the terminal well and provide an interference or press fit between the terminal and the housing and thereby retaining the terminal in place. In an embodiment a housing can be provided with terminal cavities on each side with a receiving pocket for the LED array therebetween. In an alternative embodiment the holder can include a housing with one terminal cavity and support one terminal and can be configured so that two such holders can mount to opposing sides of an LED array so as to secure the LED array in position. For example, the LED array could be mounted to a substrate and each of the individual housings would in turn be separately mounted to the substrate to secure the LED array in position. In this embodiment the same housings can be used to secure different LED arrays of different sizes. As can be appreciated, this allows for substantial flexibility in securing a range of LED arrays while minimizing the need for tooling or stocking a large range of holders.

Specifically, LED assemblies 10, 110, 210 are depicted and will be discussed in turn, it being understood that certain features can be used in different combinations not shown for purposes of brevity.

The LED assembly 10 includes an LED array 20 with a plate 22 that supports a light engine 24 and includes at least two pads 26 on the same side of the plate, the two pads being configured to provide power to the LED array. The design of the LED array is often used with a light engine 24 that has chip-on-board (COB) style LEDs covered by phosphorous layer but the Led assembly is not intended to be limited to such configurations. Preferably the plate will offer good thermal conductivity so as to provide an effective thermal path from the light engine 24.

A holder 30 includes a housing 31 that includes a terminal well 35 that supports a terminal 50 and the terminal well includes a first conductor notch 39*a* and a second conductor notch 39*b*. A wire 15 with an insulative layer 15*a* over a conductor 15*b* can be inserted into one or both of the conductor notches 39*a*, 39*b* and be electrically connected to the terminal 50. In order to minimize the overall size of the LED module package, the terminal is constructed so that it can engage a respective wire at an opposing angle. As show in the Figs., the angle can be set at 90 degrees but may be others angles may be provided depending on the specific requirement. To further decrease the terminal size, the wire trap may be constructed in a manner in which the wire is inserted substantially through the terminal prior to engaging the retention portion of the wire trap.

The housing 31 includes a fastener mount 33 that is configured to allow the housing to be secured to a supporting surface. To secure the LED array in position, the housing 30 includes a shelf 37 with an edge 37*a* that allows light from the supported LED array to be directed in a desired manner. As depicted, the edge 37*a* is curved to provide a more desirable light distribution pattern and can be configured to maintain a constant distance between the edge 37*a* and the light engine 24. The shelf includes a groove 41 that is aligned with the pad of the LED array and further includes a notch 42 in the terminal well 35 (which is depicted as having four walls) and includes a floor 43 that, as depicted, is configured so that when a terminal when pressed down to the floor 43, the terminal well 35 is deep enough to allow the terminal well 35 to extend above the terminal 50. To help support and align the terminal, the terminal well 35 includes a projection 45.

The terminal 50 includes a base 52 with an arm 54 that is cantilevered from the base 52 and supports a contact 56 on a distal end of the arm 54. The arm 54 can extend beyond the edge 37*a*. The base supports a first spring arm 57 that is configured to trap a wire between the first spring arm 57 and a wall 58 and provides a first wire trap 51. The base 52 further supports a second spring arm 59 that is configured to trap a wire between the second spring arm 59 and the base and provides a second wire trap 53. As can be appreciate, the spring arms can be configured to extend in different angles such as 90 degree apart (e.g., one at a horizontal and one at a vertical angle) to allow the terminal to be formed in a more compact manner. The terminal 50 includes a bottom surface 55 that rests on the floor 43. In an embodiment, the arm 54 extends initially in a direction parallel with the base 52 for a distance and then extends downward so that the contact 56 is positioned below the bottom surface 55. As can be appreciated from FIG. 2, for example, a height of the terminal 50 is less than the height of the terminal well 35 so that the terminal 50 is recessed in the terminal well 35. The recessing, while not required, helps provide electrical isolation.

To secure the terminal 50 in position, a plurality of terminal retainers 55*a*-55*d* are provided. The terminal retainers 55*a*-55*b* can be configured to engage sides of the terminal well 35 and can be configured to have a press-fit design so as to skive into the sides of the terminal well. The terminal retainer 55*a* is double-sided and is configured to engage the projection 45 on opposing sides so as to help ensure the arm 54 is properly aligned with notch 42.

As can be appreciated, the depicted terminal retainers 55*a*-55*d* are configured to engage the terminal well 35 so that at least two points of contact are on one side of where the arm 54 extends from the base 52 while at least two points of contact are on a second side of the arm 54 extends from the base 52. Furthermore, as depicted this is true along both line 52*a* and 52*b*, which are perpendicular to each other. This configuration of having two contacts on both sides of two perpendicular lines helps provide a more even distribution of forces and helps ensure the terminal 50 is securely positioned in the terminal well 35. It should be noted that while the use of four terminal retainers is desirable, alternative embodiments can also be provided with some other number of terminal retainers or even additional components (such a cover) that secure the terminal in position. A benefit of the depicted configuration is that the terminal can be held so that it can provide a reliable and consistent force on a pad of the associated LED array.

As can be appreciated, the terminal 50 is configured so that the contact 56 extends below the bottom surface 55. The notch 42 and the groove 41 thus allow the contact 56 to extend below the shelf 37. This helps ensure a reliable electrical connection is made between the terminal and the pads. Each terminal includes a pair of attachment points for the power source. Thus, the depicted terminal construction consists of a first wire trap that can receive a first conductor and a second wire trap that can receive a second electrical conduction. In order to minimize the overall size of the LED module package, the electrical terminal is constructed with the wire traps engaging each respective electrical conductor at an opposing angle. As show in the figures, the angle can be set at 90 degrees but may be others angles may be provided depending on the specific requirement. Further to decrease the terminal size, the wire trap may be constructed in a manner in which the electrical is inserted through the terminal prior to engaging the retention portion of the wire trap.

Figure 9:
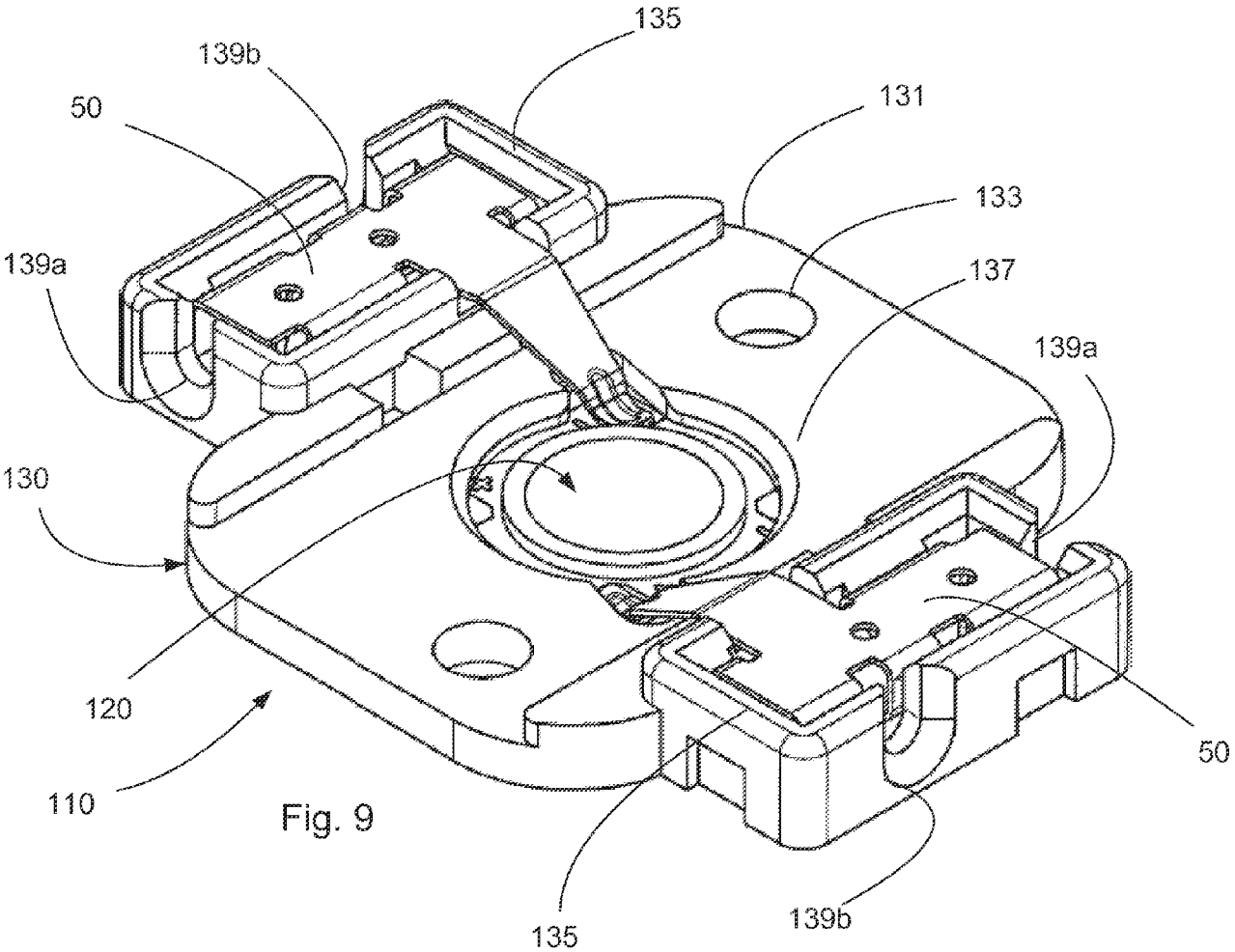
FIG. 9 illustrates a perspective view of an exemplary embodiment of an LED module.
Figure 10:
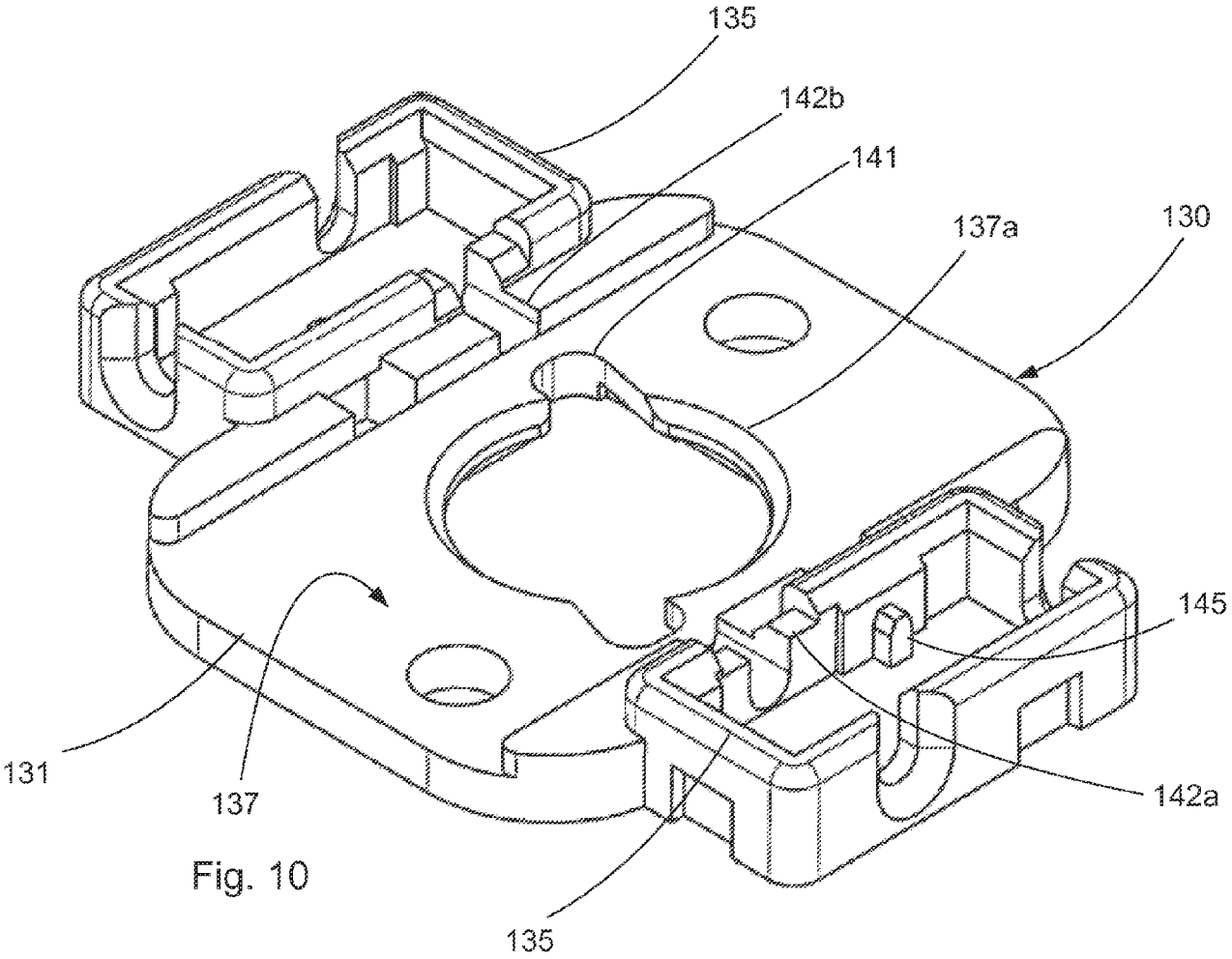
FIG. 10 illustrates a perspective view of an exemplary embodiment of a holder.

FIGS. 9-10 illustrate another embodiment of a LED module 110 with a holder 130 that can use the terminals 50 and supports an LED array 120. The LED array 120 can be any desirable LED array that includes pads arranged so as to allow for top-mounted terminal connection.

The holder 130 includes a housing 131 that includes two terminal wells 135 that are configured similarly to the terminals wells 35 discussed above. Each terminal well 135 includes conductor notches 139*a*, 139*b* that receives inserted wires and a projection 145. The terminal well also includes a notch 142*a* that is in communication with notch 142*b* and is aligned with groove 141. The housing 131 includes a shelf 137 that can press down on the LED array 120 and includes an edge 137*a* that is depicted as having a curved shape to provide improved light distribution. As discussed above, the arm 54 extends through the notches 142*a*, 142*b* and groove 141 so as to direct the contact 56 below the shelf 137. One difference between holder 130 and holder 30 is that holder 130 is a one piece design. For smaller LED arrays a one piece design may be more desirable. However, a two-piece holder is suitable for many applications and offers greater flexibility as well as the opportunity to use a smaller mold to form the housing.

Figure 11:
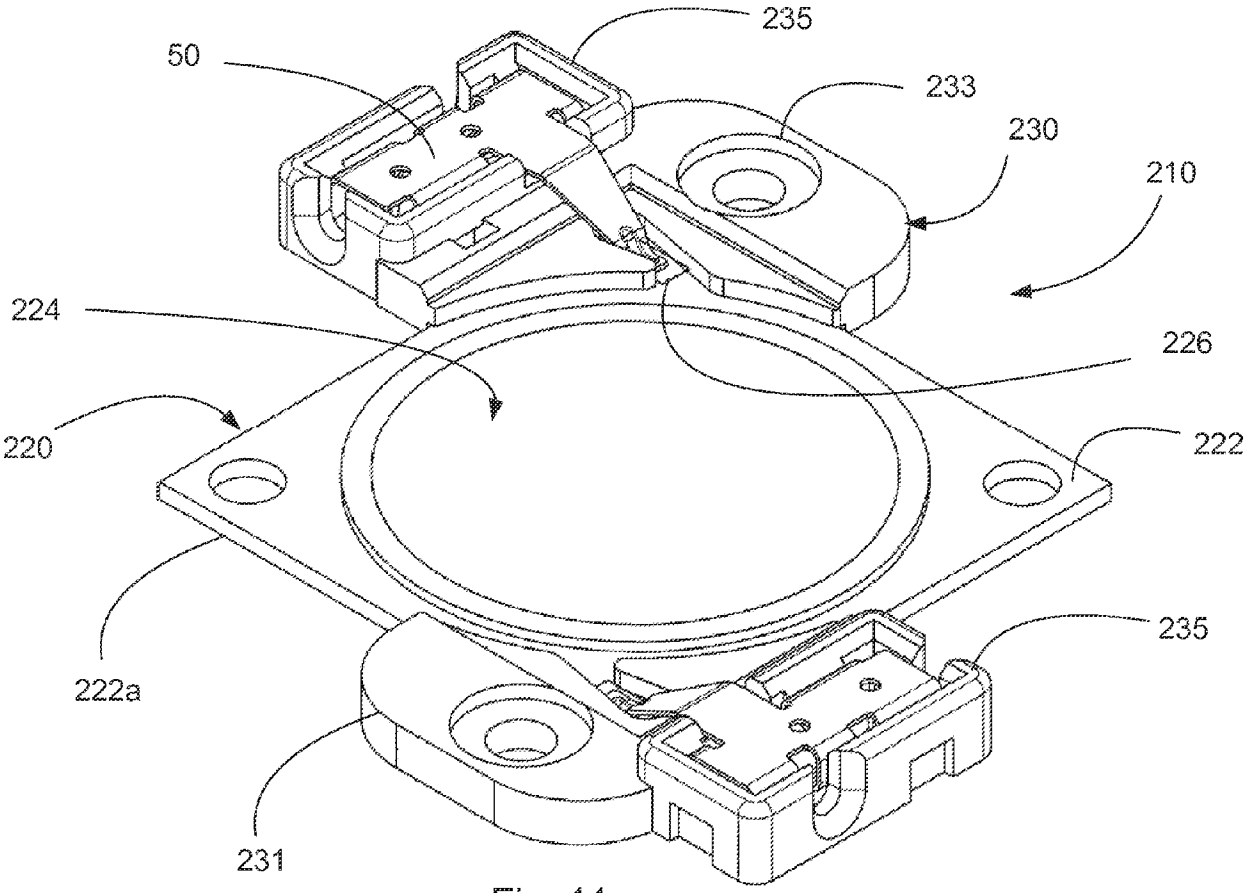
FIG. 11 illustrates a perspective view of an exemplary embodiment of an LED module.
Figure 12:
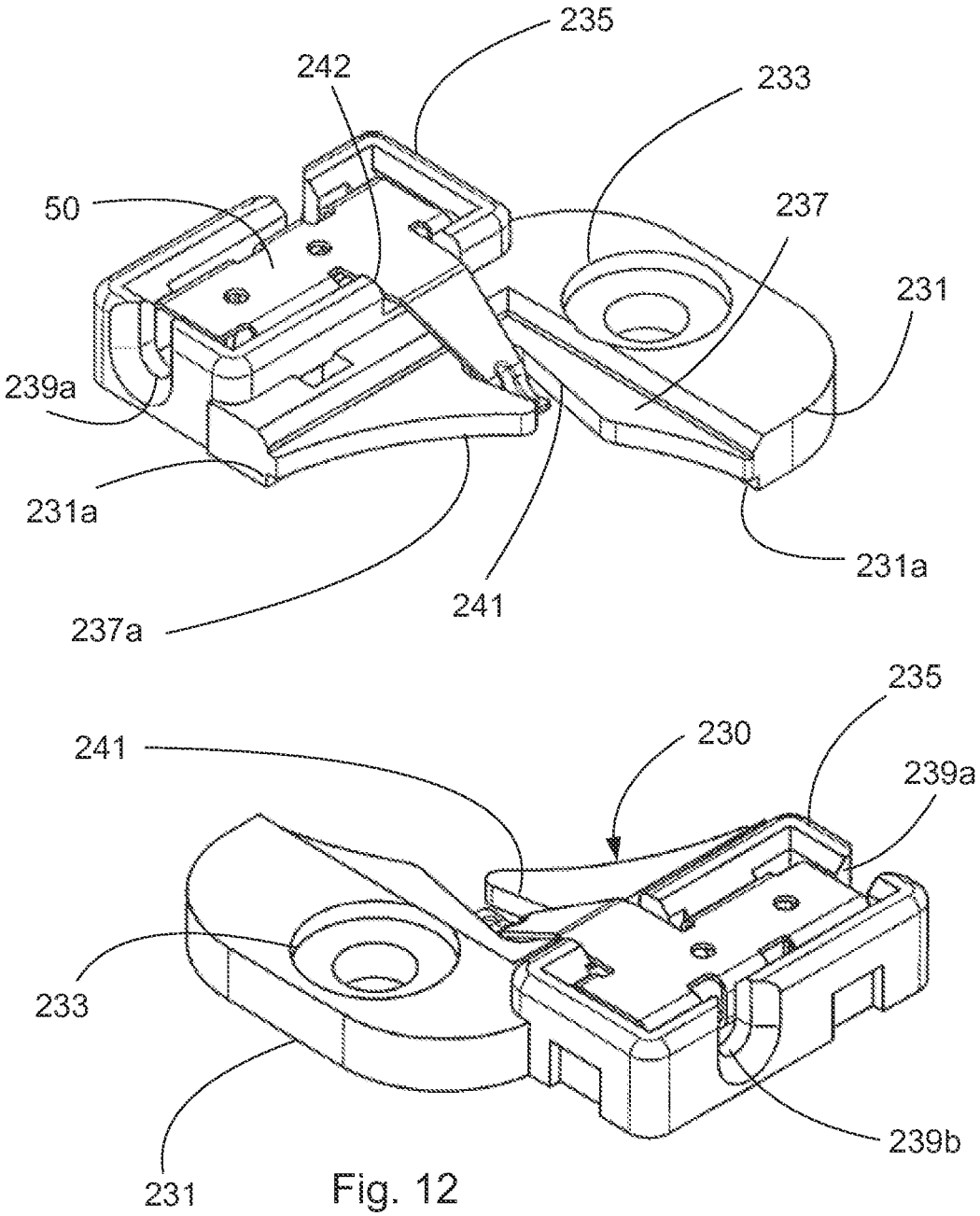
FIG. 12 illustrates a perspective view of an exemplary embodiment of a holder.

FIGS. 11-12 illustrate an embodiment of a LED module 210 that includes an LED array 220 with a plate 222 that supports a light engine 224 and pads 226. The LED module includes a holder 230 that includes two housings 231 that each support a terminal 50. The plate 222 includes an edge 222*a* that the housing 231 is configured to engage with a lip 231*a* (it being understood that the housing 131 and housing 31 can have a similar lip feature).

The housing 231 includes a terminal well 235 with conductor notches 239*a*, 239*b* and a projection in a configuration that can be substantially similar to the embodiments discussed above. The housing includes a fastener mount 233 and a shelf 237 with an edge 237*a* that is curved. A groove 241 is provided in the shelf 237 and the groove 241 is aligned with a notch 242 in the terminal well 235.

Figure 2:
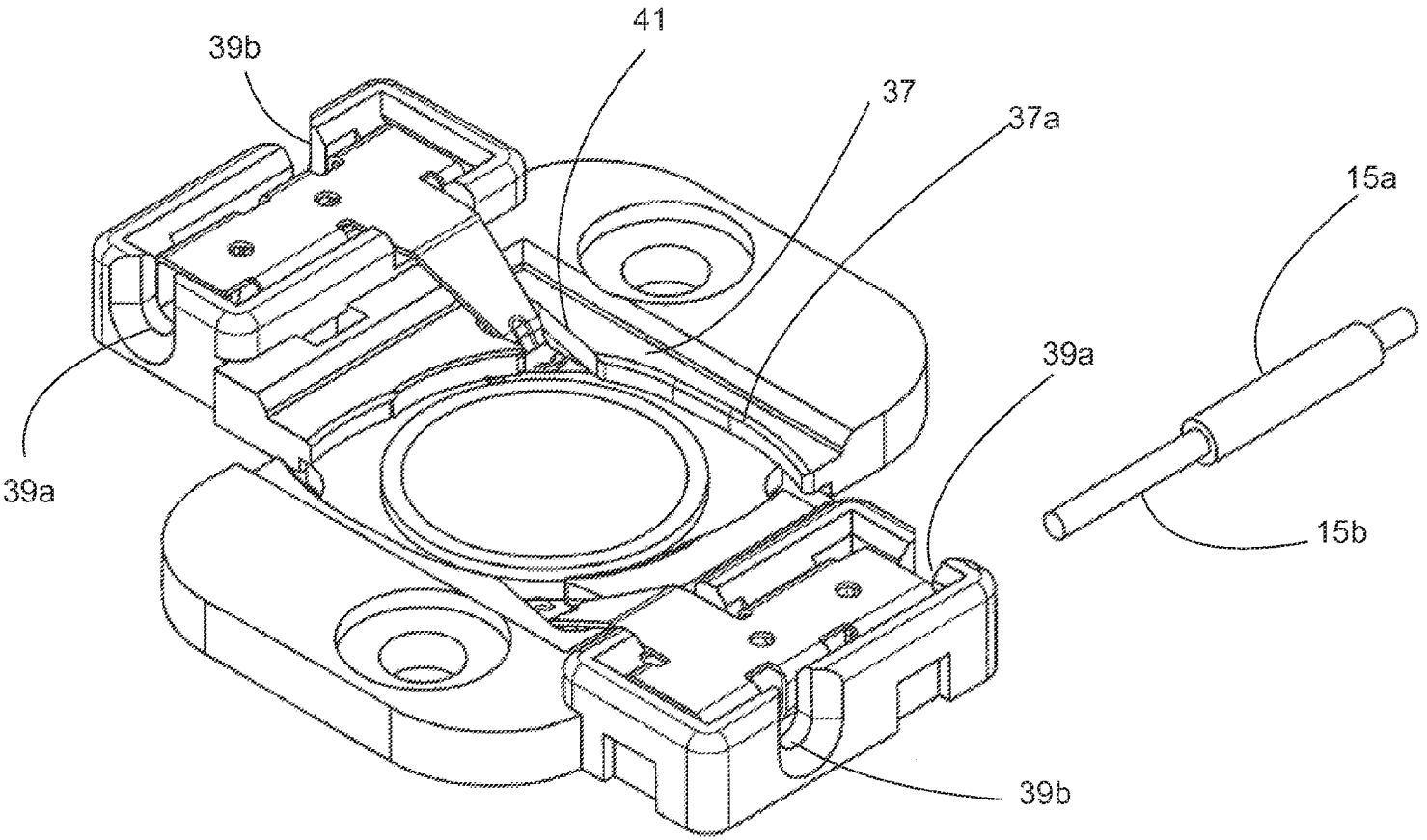
FIG. 2 illustrates a perspective view of the embodiment depicted in FIG. 1.
Figure 3:
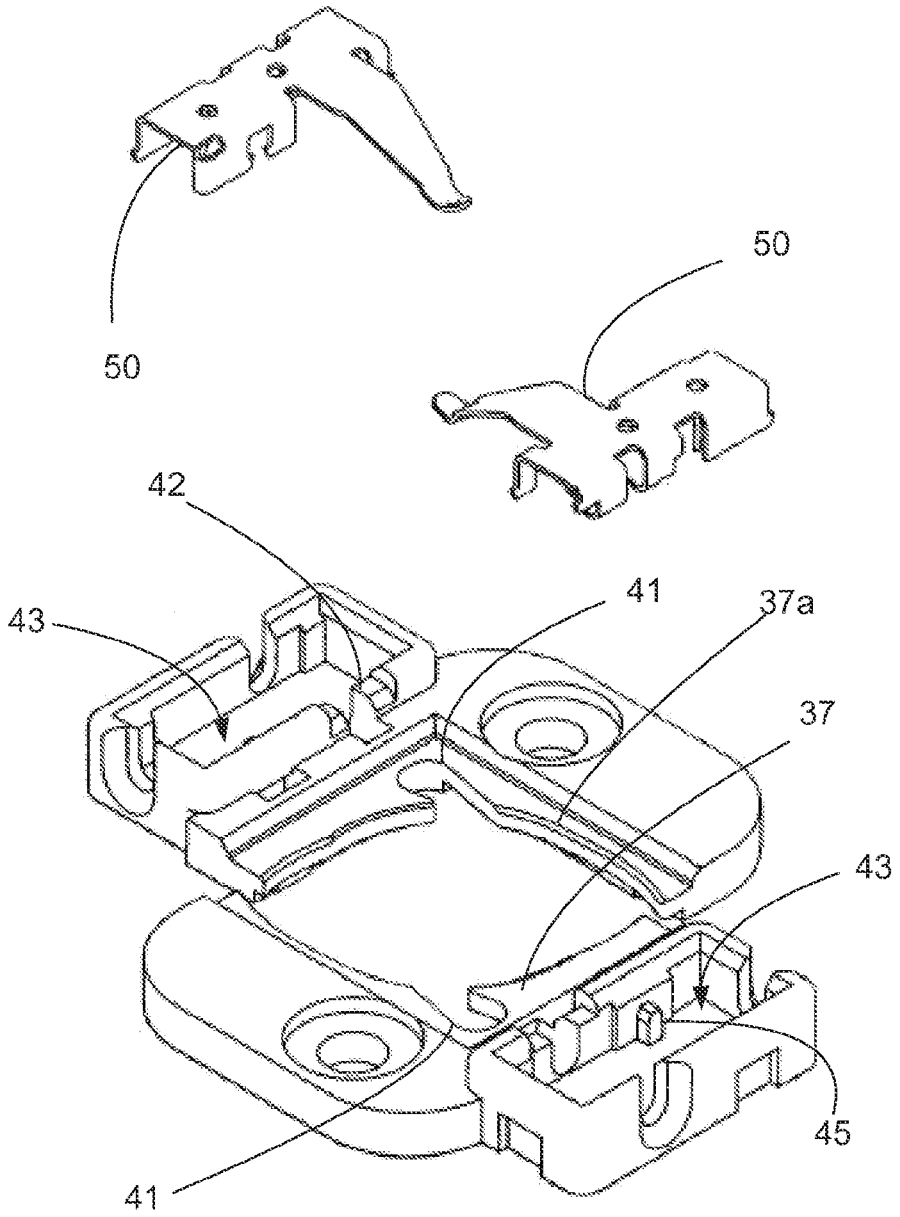
FIG. 3 illustrates a partially exploded perspective view of a holder depicted in FIG. 1.
Figure 4:
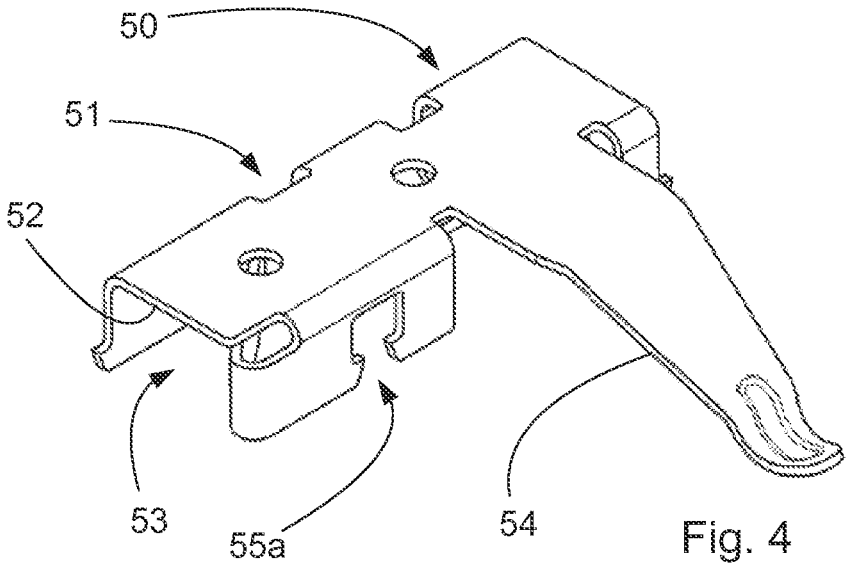
FIG. 4 illustrates a perspective view of an exemplary embodiment of a terminal.
Figure 5:
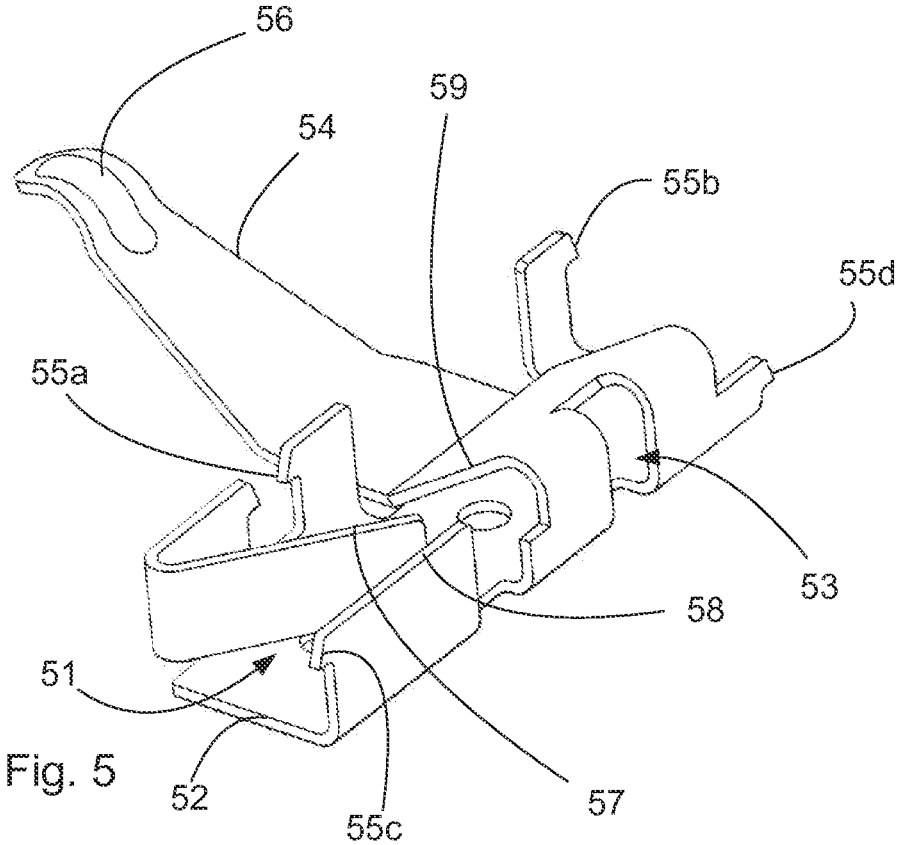
FIG. 5 illustrates another perspective view of the terminal depicted in FIG. 4.
Figure 6:
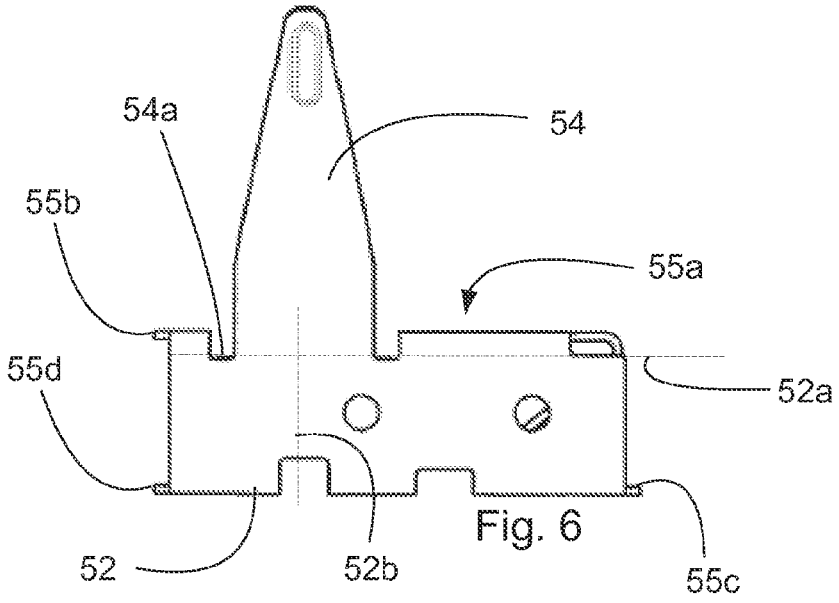
FIG. 6 illustrates a plan view of the terminal depicted in FIG. 4.
Figure 7:
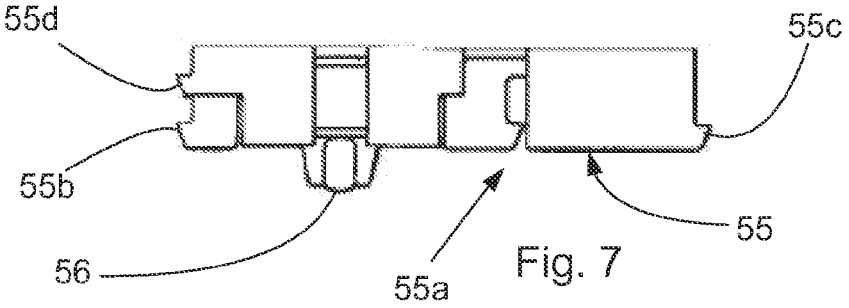
FIG. 7 illustrates an elevated side view of the terminal depicted in FIG. 4.
Figure 8:
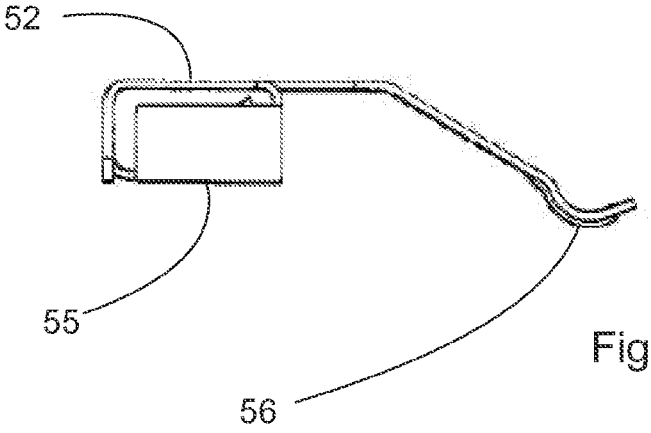
FIG. 8 illustrates an elevated front view of the terminal depicted in FIG. 4.

As can be appreciated from FIGS. 11-12, the two-piece holder configuration can be used for different sized LED arrays. For example, the holder in FIGS. 11-12 can be the same holder that is depicted in FIGS. 1-3, with the difference being the size of the LED array. As can be appreciated, this is because the holder is configured to engage a corner of the LED array and the LED array appropriately configured. Naturally, different holder configurations are possible (thus different housings can be used together) and the ability to use the same holder with different LED arrays requires that the LED arrays be configured appropriately. Having a holder that can engage secure and electrically connect to different sized arrays provides can beneficially simplify assembly efforts and reduce inventory requirements, saving time and money.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A holder, comprising:

a housing with a shelf configured to be positioned on and hold down at least two sides an LED array, the shelf including an edge, the housing further including a terminal well and a fastener mount, the terminal well including a first conductor notch and a second conductor notch, the first notch orientated along a horizontal direction, the second notch orientated at an angle along a vertical direction; and a terminal with a base positioned in the terminal well, the terminal including an arm that extends out of the terminal well and beyond the edge of the shelf, the arm having a contact on a distal end, the terminal further including a first wire trap aligned with the first conductor notch and a second wire trap aligned with the second notch and the wire traps are configured to retain an inserted wire.

2. The holder of claim 1, wherein the terminal well has a height greater than a height of the terminal and the terminal well includes a notch aligned with the arm so that the arm extends parallel from the base for a distance.

3. The holder of claim 2, wherein the shelf includes a groove aligned with the arm and the contact is positioned below the shelf.

4. The holder of claim 3, wherein the terminal includes at least three terminal retainers configured to engage the terminal well.

5. The holder of claim 1, wherein the first wire trap and the second wire trap are orientated perpendicular to each other.

6. The holder of claim 5, wherein the edge is curved.

7. The holder of claim 1, wherein the terminal well is a first terminal well, the housing further includes a second terminal well with a conductor notch, another one of the terminal positioned in the second terminal well, the two arms of the two terminals extending in opposite directions.

8. A holder, comprising:

a first housing with a shelf configured to be positioned on and hold down at least two sides an LED array, the shelf having an edge, the first housing further including a terminal well and a fastener mount, the terminal well including a first conductor notch and a second conductor notch, the first notch orientated along a horizontal direction, the second notch orientated at an angle along a vertical direction;

a second housing with a shelf configured to be positioned on and hold down at least two sides an LED array, the second housing further including a second terminal well and a fastener mount, the second terminal well including a third conductor notch and a fourth conductor notch, the third notch orientated along a horizontal direction, the fourth notch orientated at an angle along a vertical direction; wherein the first and second housing are configured to engage opposing corners of an LED array; and a pair of terminals, each terminal positioned in one of the terminal wells, each terminal including an arm that extends out of the terminal well, the arm having a contact on a distal end, each terminal further including a first wire trap aligned with the respective first and third conductor notch and a second wire trap aligned with the respective second and fourth conductor notches and configured to retain an inserted wire.

9. The holder of claim 8, wherein the first and second terminal wells have a height greater than a height of the terminal and the terminal well includes a notch aligned with the arm so that the arm extends parallel from the base for a distance.

10. The holder of claim 9, wherein the shelf includes grooves aligned with the arms and the contacts are positioned below the shelf.

11. The holder of claim 8, wherein the first wire trap and the second wire trap of each terminal are orientated perpendicular to each other.

12. The holder of claim 8, wherein each terminal includes four terminal retainers.

13. An LED module, comprising:

an LED array with a plate that supports a light engine on a first side, the plate further including two pads on the first side;

a housing with a shelf configured to be positioned on and hold down at least two sides an LED array, the shelf including an edge, the housing further including a first terminal well and a fastener mount, the first terminal well including a first conductor notch and a second conductor notch, the first notch orientated along a horizontal direction, the second notch orientated at an angle along a vertical direction; and a first terminal with a base positioned in the first terminal well, the terminal including an arm that extends out of the first terminal well to the pad, the arm having a contact on a distal end that engages one of the pads, the terminal further including a first wire trap aligned with the first conductor notch and a second wire trap aligned with the second notch and the wire traps are configured to retain an inserted wire.

14. The LED module of claim 13, wherein the shelf includes a groove aligned with the arms and the contact is positioned in the groove.

15. The LED module of claim 13, wherein the first terminal includes four terminal retainers configured to engage the terminal well and two of the terminal retainers are positioned on a first side of the arm and the other two terminal retainers are positioned on a second side of the arm.

16. The LED module of claim 13, wherein the housing is a first housing, the holder further including another of the housing and the terminal, the another housing and terminal configured to engage two different sides of the LED array.

17. The LED module of claim 13, wherein the edge is curved so as to maintain a constant distance between the edge and the light engine.

18. The LED module of claim 13, wherein the housing is configured to hold down four sides of the LED array and includes a second terminal in a second terminal well, the second terminal including an arm that extends out of the second terminal well to the other pad, the arm having a contact on a distal end that engages the other pad, the second terminal further including a third wire trap aligned with a third conductor notch formed in the second well and a fourth wire trap aligned with a fourth notch formed in the second, the third notch orientated along a horizontal direction, the fourth notch orientated at an angle along a vertical direction and configured to retain an inserted wire.

19. The LED module of claim 18, wherein the third wire trap and the fourth wire trap are orientated perpendicular to each other.

20. The LED module of claim 13, wherein the first wire trap and the second wire trap are orientated perpendicular to each other.

* * * * *